United States Patent [19]

Beech

[11] 4,160,967

[45] Jul. 10, 1979

[54] ELECTRICAL COIL ASSEMBLY

[75] Inventor: Keith J. W. Beech, Walsall, England

[73] Assignee: Lucas Industries Limited, Birmingham, England

[21] Appl. No.: 819,671

[22] Filed: Jul. 28, 1977

[30] Foreign Application Priority Data

Aug. 21, 1976 [GB] United Kingdom ..... 34933/76

[51] Int. Cl.[2] ..... H01F 27/30

[52] U.S. Cl. ..... 336/209

[58] Field of Search ..... 336/206, 198, 208, 209, 336/192; 310/208, 43

[56] References Cited

U.S. PATENT DOCUMENTS

| | | | |
|---|---|---|---|
| 1,797,768 | 3/1931 | Goad | 336/209 |
| 2,243,553 | 5/1941 | D'Entremont | 336/206 X |
| 2,275,967 | 3/1942 | Keillor et al. | 336/209 |
| 2,749,525 | 6/1956 | Henderson | 336/209 |
| 3,092,797 | 6/1963 | Wood | 336/198 |
| 3,237,137 | 2/1966 | Flaminio | 336/209 |
| 3,287,681 | 11/1966 | Caldwell | 336/192 |
| 3,317,875 | 5/1967 | Williams | 336/198 |
| 3,378,800 | 4/1968 | Libermen | 336/209 X |

*Primary Examiner*—Thomas J. Kozma

*Attorney, Agent, or Firm*—Trexler, Wolters, Bushnell & Fosse, Ltd.

[57] ABSTRACT

An electrical coil assembly comprises a rectangular, flat annular coil and a flexible annular covering of, for example, fibre board sheet surronding the coil so as to provide a substantially dustproof seal. The covering is formed by folding and glueing a blank around the coil. The blank comprises a rectangular annular portion a first pair of flaps extending one from each of two opposite outer peripheral sides of the annular portion, a second pair of flaps extending one from each of two opposite sides of the inner periphery of the annular portion and further flaps extending from the outer periphery of the annular portion. The annular portion is provided with fold lines and is of a size, when folded, to overlie opposite faces of the coil and the flaps fold around the inner and outer peripheries of the coil to provide a substantially dustproof seal.

10 Claims, 4 Drawing Figures

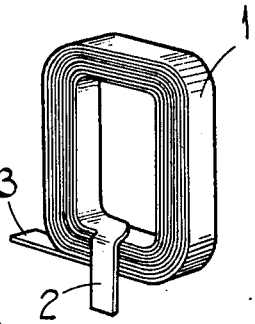
FIG. 1.
FIG. 2.
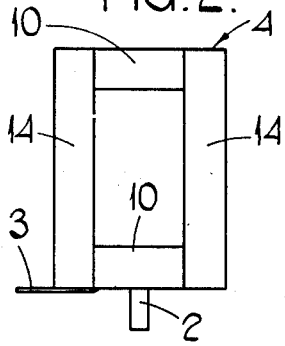
FIG. 3.
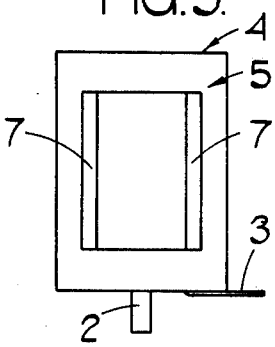
FIG. 4.
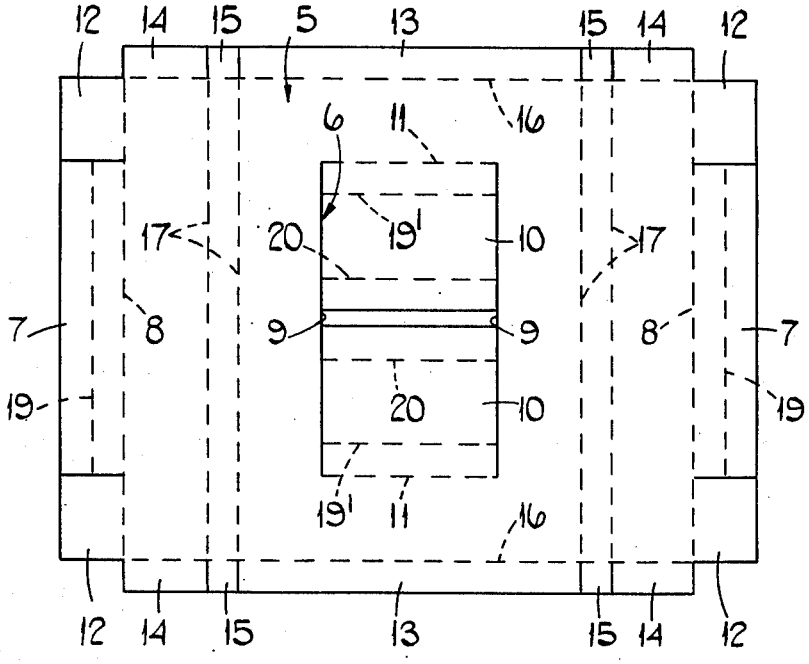

ELECTRICAL COIL ASSEMBLY

This invention relates to an electrical coil assembly and is particularly, though not exclusively, concerned with an electrical coil assembly for use in a field coil arrangement of a motor vehicle starter motor.

The invention is also particularly, though not exclusively, concerned with an electrical coil assembly in which the electrical coil is formed from a spirally wound conductor strip so that the thickness of the coil corresponds substantially to the thickness of the strip, there being provided a strip of insulation which is also spirally wound with the turns of the coil to separate the said turns. With electrical coils for use as field coils for electric motors, it is necessary to provide electrical insulation thereover in order to prevent ingress of dust or dirt. Ingress of dust or dirt, particularly dust from the brushes of the motor, can cause shorting out of the turns of the coil. Accordingly, it has previously been the practice to employ an impregnated cotton strip which is helically wound around the coil. However, this type of insulation requires the use of fairly expensive machinery and is also expensive because impregnated cotton strip or tape is expensive. In order to overcome this disadvantage, it has also been the practice to dip or spray the coil with a coating of electrically insulating resin material. However, it is found that with this type of insulation, there is a tendency for the insulation to crack in service due to the very high temperature variations encountered, particularly in the case of motor vehicle electric starter motors.

It is an object of the present invention to obviate or mitigate the above disadvantages.

According to one aspect of the present invention, there is provided an electrical coil assembly comprising an annular electric coil and an annular covering surrounding said coil, said covering being formed of a flexible, electrically insulating sheet which has been cut and folded to provide flaps which seal the inner and outer peripheries of the coil so as to provide a substantially dustproof seal.

Preferably, a sealant, e.g. a mastic or dipped sealant, is provided around leads to the coil at locations where the leads extend from an opening or openings in the covering so as to ensure a dustproof seal between the covering and the leads.

The coil of the assembly may be of a type which has a rectangular aperture therethrough. In such a case, it is preferred to provide a flap for overlapping each wall of the aperture and to arrange for the flaps for adjacent walls to overlap each other so that an effective seal at the corners of the aperture in the coil is obtained. This is preferably obtained by making each flap of a width which is greater than the length of the respective wall of the aperture.

Most advantageously, the covering is formed from a blank of the type defined in the next following paragraph.

Also according to the present invention, there is provided a blank for forming a covering to an electrical coil of substantially rectangular annular form with a substantially rectangular aperture therethrough, said blank being formed of a flexible, electrically insulating sheet material and comprising (a) a substantially rectangular annular portion having a substantially rectangular aperture, (b) a first pair of flaps extending one from each of two opposite sides of the annular portion in substantial alignment with the aperture in the annular portion, each flap being joined to the annular portion over a fold line which is substantially parallel to a respective one side of said aperture and having a width which is not less than the length of said respective one side, (c) a second pair of flaps joined to the annular portion on respective fold lines which are at right angles to the first mentioned fold lines, each flap of the second pair being in substantial alignment with said aperture and having a width which is not less than the length of a respective other side of the aperture, and (d) further flaps extending from the outer periphery of the annular portion arranged to cover, in use, parts of the coil not covered by the annular portion or by the first and second pairs of flaps.

Preferably, the width of each flap of the first pair is slightly greater than the length of the respective one side of the aperture.

Preferably also, each flap of the second pair is joined to the annular portion at the respective other side of the aperture.

Conveniently, the annular portion has two spaced pairs of parallel fold lines thereacross, the aperture being disposed between the pairs of fold lines so that each one side of the aperture is parallel to said pairs of fold lines.

The present invention also resides in a dynamo electric machine including at least one electrical coil assembly according to the present invention.

An embodiment of the present invention will now be described, by way of example, with reference to the accompanying drawing, in which:

FIG. 1 is a perspective view of an electrical coil forming part of an electrical coil assembly according to the present invention, and FIG. 2 is a view of one face of an electrical coil assembly according to the present invention of which the electrical coil of FIG. 1 forms part, FIG. 3 is a view of an opposite face of the electrical coil assembly of FIG. 2, and FIG. 4 is a plan view on a larger scale of a blank for forming a covering of the electrical coil assembly illustrated in FIGS. 2 and 3.

Referring to the drawings, the electrical coil illustrated in FIG. 1 comprises a copper strip 1 which is spirally wound to produce a substantially rectangular, flat, annular coil having a substantially rectangular aperture therethrough. The strip 1 is bent at its ends to provide leads 2 and 3. A spirally wound strip of impregnated paper is provided between adjacent turns of the strip 1 in order to electrically insulate these. The coil illustrated in FIG. 1 is provided with a covering indicated generally by arrow 4 in each of FIGS. 2 and 3. The covering 4 is formed from a flexible, electrically insulating and heat resistant vegetable fibre board which is non-porous. In this embodiment, the board is formed of PRESSPAHN. The covering 4 is produced from the pre-cut blank illustrated in FIG. 4.

Referring now to FIG. 4, the blank comprises a substantially rectangular annular portion 5 having a substantially rectangular aperture 6 therethrough. A first pair of flaps 7 extend integrally one from each of two opposite sides of the annular portion 5 in substantial alignment with the aperture 6. Each flap 7 is joined to the annular portion 5 over a fold line 8 which is parallel to a respective one side 9 of the aperture. The width of each flap 7 is slightly greater than the length of each side 9 of the aperture 6.

The blank also comprises a second pair of flaps 10 which are integrally joined to the annular portion 5 over fold lines 11 and are disposed in the aperture 6. Each fold line 11 coincides with one of said other sides of the aperture 6 so that each fold line 11 is disposed at right angles to the fold lines 8. Thus, the flaps 10 and the aperture 6 can be formed together by a simple die cutting operation at the time of cutting out the blank from a larger sheet. Further flaps 12–15 extend integrally from the outer periphery of the annular portion 5. As can be seen from FIG. 4, four further flaps 12 are provided which are disposed at each side of the two flaps 7 and are joined to the annular portion 5 by extension of the respective fold lines 8. The remaining further flaps 13–15 are connected to the annular portion 5 along fold lines 16 which are perpendicular to the fold lines 8.

The annular portion 5 is also provided with two pairs of spaced, parallel fold lines 17. The aperture 6 is disposed between the pairs of fold lines 17 so that the sides 9 are parallel to the fold lines 17. The distance between the fold lines 17 of each pair is substantially equal to the thickness of the coil. The flaps 15 are in alignment with the parts of the annular portion 5 between the respective pairs of fold lines 17.

Furthermore, each flap 7 is provided with an intermediate fold line 19 which is parallel to the respective fold line 8 and spaced therefrom a distance equal to the spacing between the fold lines 17 of each pair. Similarly, each flap 10 is provided with a fold line 19' which is parallel to the respective fold line 11 and spaced therefrom by a distance equivalent to the thickness of the coil. Each flap 10 is also provided with a further fold line 20 which is spaced from the free end of the flap 10 by the same distance. Each of the flaps 13–15 has a length (i.e. a distance from fold line 16 to its free end) which is equal to the thickness of the coil.

All the fold lines in the blank are provided by preformed crease lines which facilitate bending of the various parts of the blank at the fold lines.

The manner in which the blank is folded in order to provide the covering will now be described. In this description, the front face of each part of the blank is that face which is illustrated in FIG. 4 and the rear face of each portion of the blank is that which is not illustrated in FIG. 4.

1. Flaps 7 together with the outer parts of the annular portion 5 are folded upwardly (as viewed in FIG. 4) about the innermost fold line 17 of each pair, and the flaps 13 are folded upwardly about respective fold lines 16. Flaps 15 are folded so that the rear faces thereof abut against the front faces of the flaps 13. This produces a shallow tray. If desired, the operator assembling the field coil assembly may be provided with such a tray in which the rear faces of the flaps 15 have been adhesively secured to the front faces of the respective flaps 13.

2. The coil is placed in the tray with the aperture in the coil aligned with the aperture 6. The flaps 10 are folded upwardly about fold lines 11 through the aperture in the coil. The width of each flap 10 is slightly greater than the corresponding dimension of the aperture in the coil.

3. The outer parts of the annular portion 5 are then folded about the outermost fold line 17 of each respective pair so that the front faces of said outer parts engage against the exposed front face of the coil. At the same time, the flaps 7 are folded about their respective fold lines 8 and inserted through the aperture in the coil and through the aperture 6 in the annular portion 5. In this position, the flaps 12 lie against the front face of the coil, with a slight overlap of the flaps.

4. The flaps 10 are then folded about fold lines 19' so that the front faces of the flaps 10 lie over the respective flaps 12.

5. Finally, the front faces of the flaps 14 are glued to the rear faces of the flaps 13 and the portions of the flaps 10 between the fold lines 20 and the free ends of the flaps 10 are also glued to the rear faces of the respective flaps 13. Also, the free ends of the flaps 7, i.e. the portions beyond fold lines 19 are glued to the rear face of the annular portion 5.

In the above-described embodiment, apertures are formed for the leads 2 and 3 in the blank at the time when it is folded to complete the covering 4. However, it is preferred to provide suitably located apertures or slits to accommodate the leads 2 and 3 in the blank as manufactured. The disposition of these apertures or slits will vary depending upon the positioning of the leads 2 and 3, it being appreciated that the positioning of these leads 2 and 3 can be varied at will to suit the motor to which the coil assembly is to be fitted.

In use, each coil assembly is bent so as to be of arcuate form to conform to the shape of the casing into which it is to be fitted. With an electrical coil assembly of the type described hereinabove, the coil is bent to arcuate form so that the face illustrated in FIG. 2 is of convex form and the face illustrated in FIG. 3 is of a concave form.

The glue used to secure the various flaps of the covering 4 together is preferably a hot melt adhesive. However, it is within the scope of the present invention to employ any type of adhesive which has a suitable temperature resistance. If desired, any gaps between the leads and the covering may be filled in with a sealant such as a mastic, or a sealant which is applied by a dipping operation.

The above-described coil assembly is easy to assemble and is much cheaper to manufacture than the prior art impregnated cotton strip wound electrical coil both from a raw material point of view and from a capital equipment point of view. The coil assembly according to the present invention also possesses the advantage over electrical coils which have been dipped into a bath of electrically insulating resin material, that the electrical coil assembly as described above is less likely to suffer from premature failure of the electrically insulating covering during the wide ranging temperature conditions encountered in service.

I claim:

1. An electrical coil assembly comprising an annular electric coil which has a rectangular aperture therethrough and has inner and outer peripheries and front and rear faces, and a covering over said coil, said covering being formed of a flexible, electrically insulating sheet which, when folded, is shaped to completely cover said inner and outer peripheries and said front and rear faces of said coil to provide a substantially dust-proof seal for the coil when secured in position, said sheet having a rectangular aperture therethrough and including flaps which extend along opposite sides of said sheet, engage in said rectangular aperture in said sheet so as to overlie one pair of opposite side edges of the inner periphery of said coil, and are wider than the corresponding dimension of said rectangular aperture in said sheet.

2. An assembly as claimed in claim 1, further comprising leads extending from the coil externally of the covering, and a sealant around the leads at locations where the leads extend through the covering so as to ensure a dustproof seal between the covering and the leads.

3. An assembly as claimed in claim 1, wherein the sheet includes further flaps which overlie the other pair of opposite side edges of said inner periphery of said coil, each of said flaps having a width which is greater than the length of the respective side edge which it overlies.

4. An assembly as claimed in claim 1 wherein said further flaps are extended in length so as to overlie parts of said outer periphery of said coil.

5. An electrical coil assembly as claimed in claim 3 wherein said sheet includes additional flaps which are themselves overlapping and which overlie portions of one of said faces of said coil.

6. An assembly as claimed in claim 5, wherein the coil is a planar coil which is bent so that it faces are of arcuate form.

7. An assembly as claimed in claim 6, wherein said further flaps are provided on the convex face of said coil.

8. An assembly as claimed in claim 5 wherein said additional flaps are themselves overlapped by respective ones of said further flaps.

9. An assembly as claimed in claim 3, wherein the sheet includes (a) a rectangular annular portion having said rectangular aperture, (b) a first pair of flaps which constitute the first mentioned flaps, (c) a second pair of flaps which constitute said further flaps, said first pair of flaps extending one from each of two opposite sides of the annular portion in substantial alignment with the aperture in the annular portion, each flap of the first pair being joined to the annular portion over a fold line which is substantially parallel to a respective one side of the aperture, the second pair of flaps being joined to the annular portion on respective fold lines which are at right angles to the first mentioned fold lines each flap of the second pair being in substantial alignment with said aperture and having a width which is not less than the length of a respective other side of the aperture, and (d) additional flaps which extend from the outer periphery of the annular portion and which are so shaped and disposed as to cover parts of the coil not covered by the annular portion or by the first and second pairs of flaps.

10. An assembly as claimed in claim 9, wherein each flap of said second pair is joined to said annular portion at the respective other side of said aperture.

* * * * *